United States Patent [19]

Clark et al.

[11] Patent Number: 4,509,587

[45] Date of Patent: Apr. 9, 1985

[54] PASSIVE TEMPERATURE CONTROL SHIPMENT CONTAINER

[76] Inventors: Thomas S. Clark, 2177 Webster St., Palo Alto, Calif. 94301; William S. Kennedy, 3043 Emerson Ave., Palo Alto, Calif. 94306

[21] Appl. No.: 412,579

[22] Filed: Aug. 30, 1982

[51] Int. Cl.[3] ..... F25B 29/00

[52] U.S. Cl. ..... 165/61; 165/63; 165/64; 165/47; 62/372; 62/457; 62/384

[58] Field of Search ..... 62/371, 372, 457, 529, 62/530; 165/30, 61, 62, 63, 64

[56] References Cited

U.S. PATENT DOCUMENTS

| | | | |
|---|---|---|---|
| 181,326 | 8/1876 | Ferguson | 165/61 |
| 276,590 | 5/1883 | Irish | 62/457 |
| 493,326 | 3/1893 | Beard | 62/457 |
| 519,417 | 5/1894 | York | 62/371 |
| 624,165 | 5/1899 | Bowdish | 62/457 |
| 3,214,937 | 11/1965 | Cannon et al. | 165/61 X |
| 3,402,569 | 9/1968 | Myers | 62/371 |
| 3,762,465 | 10/1973 | Gutlhuber | 165/61 X |
| 3,888,303 | 6/1975 | Skala | 165/61 X |
| 4,106,552 | 8/1978 | Hufford | 165/30 X |
| 4,300,356 | 11/1981 | Notaro et al. | 62/457 |
| 4,304,293 | 12/1981 | Scheiwe et al. | 165/30 X |
| 4,388,813 | 6/1983 | Gardner et al. | 62/371 X |

*Primary Examiner*—Albert W. Davis, Jr.
*Attorney, Agent, or Firm*—Robert G. Slick

[57] ABSTRACT

A passive temperature control shipment container is provided having a central chamber surrounding a sample or specimen wherein the central chamber has two conductive walls, one of which is in contact with a heat source and one with a heat sink to provide a specified temperature change profile and to maintain a specified temperature time relationship in the shipping container.

2 Claims, 8 Drawing Figures

PASSIVE TEMPERATURE CONTROL SHIPMENT CONTAINER

SUMMARY OF THE INVENTION

The present invention arose out of a requirement to provide a controlled temperature change for an object such as a biological sample and then to maintain that object at a specified temperature during shipment of up to 22 hours duration. A method of achieving the specified temperature change profile and of maintaining the specified shipping temperature and time all within a single passive shipping container is thus the object of the invention. The structure can be employed in designing to a broad variety of the initial and final temperature, temperature change profiles and temperature maintenance times.

In its broadest form the invention consists of three adjacent chambers which may or may not be insulated from external thermal effects, joined by conductive baffles such that the center chamber is subjected to a temperature/time profile dependent in part upon its mass and specific heat, the temperature passively maintained in each of the side chambers, and the degree of passive control applied to vertical temperature gradients within each of the three chambers. In some embodiments of the invention, one or more of the chambers is horizontally divided into two or more convective cells by horizontal conductive baffles to control the establishment of vertical thermal gradients due to temperature and or density characteristics of the media employed. By selection of the media in each chamber, the relative masses of material in each chamber, the area and conductivity of each interconnecting baffle, and the number of horizontal convective cells in each chamber, a wide range of temperature change profiles, equilibrium temperatures and temperature maintenance times can be achieved.

Other objects and features of the invention will be described in the balance of the specification.

DESCRIPTION OF THE PREFERRED EMBODIMENTS

Figure 1:
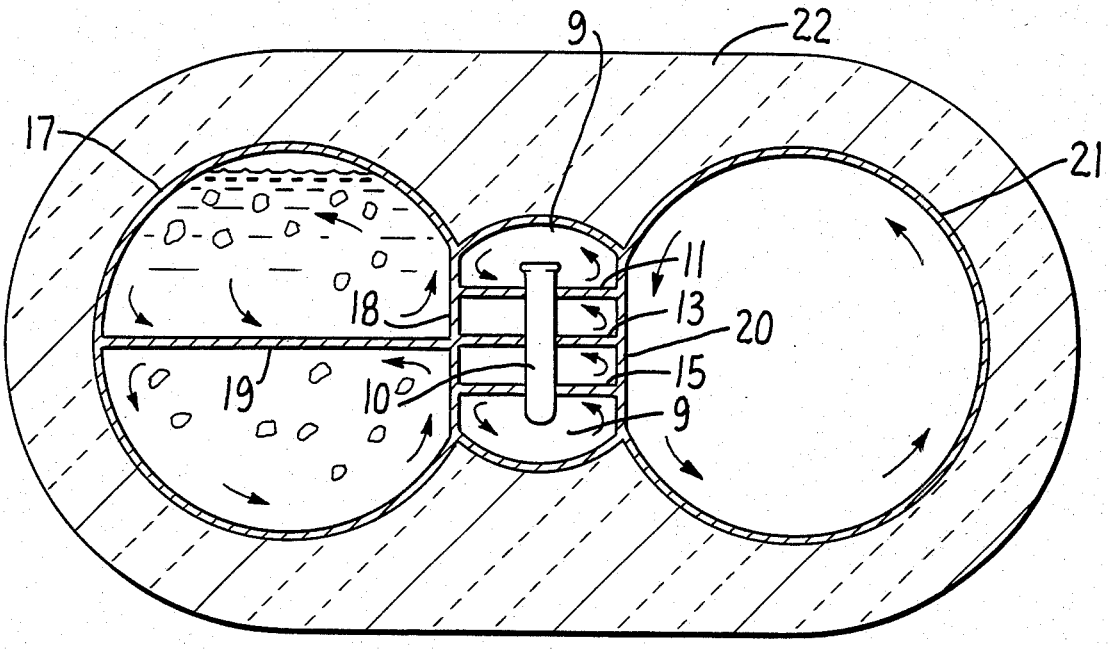
FIG. 1 is a sectional view illustrating one embodiment of the present invention.

FIG. 1 is a schematic representation of the invention. The central "controlled" chamber 9 is shown divided into four convective cells by means of horizontal baffles 11, 13, and 15. These baffles may also serve to support sample tube 10. The left or cold chamber 17 is the "heat sink" and is shown divided into two convective chambers by horizontal baffle 19. The right hand or hot chamber 21 is the heat source and is shown undivided.

A vertical heat conductive wall 18 connects chambers 9 and 17 while a similar wall 20 connects chambers 9 and 21. The whole is surrounded by insulation 22.

Operation of the invention proceeds as follows:

1. A control bath is established at its desired initial temperature, e.g., 35° C. in chamber 9. This may be higher than the heat source 21, lower than the heat sink 17 or between them.

2. The object to be temperature controlled such as sample tube 10 is inserted into the control bath.

3. The heat source and heat sink are "activated"—that is, thermal contact is established at both "hot" and "cold" conductive baffles called "active walls." This can be accomplished, for example, through removal of a thermal barrier (not illustrated) or by loading the media into each side chamber at the time the temperature change is to be initiated.

4. The heat sink shown at 17 is ice and water in two horizontal convective chambers connected by the horizontal conductive baffle 19. Water circulates in each by convection maintaining the cold active wall at or near 0° C.

5. The heat source shown in chamber 21 is air, and, for this schematic example, ambient room temperature air of sufficient mass to maintain the "hot" active wall 20 at or near an ambient temperature, say 25° C.

6. The control bath in chamber 9 average temperature will begin to move exponentially towards an equilibrium temperature. The desired temperature profile and equilibrium temperature can be predicted analytically using a model based upon the thermal design example below. Empirical verification of the basic invention demonstrated strong vertical thermal gradients caused by more dense cold water sinking to the bottom of each chamber. This phenomenon was most pronounced in the control bath and was compounded by the unique characteristic exhibited by water where its maximum density occurs at +3.9° C.

7. Convective cell function is the same in any chamber. Fluid moves convectively up or down each active wall resulting in circulation within each convective cell. The horizontal conductive baffle transmits heat always in opposition to any thermal gradients being established. In the heat sink example, 0° C. water below the baffle cools the 3.9° C. more dense water above, upsetting the adverse thermal gradient and maintaining the cold active wall closer to the desired 0° C. Control bath cells function in like manner except that the heat transfer is upward effectively disrupting the strong thermal gradient (up to 15° C. observed empirically) being established by density effects. Top and bottom cells are corrected to a lesser degree by virtue of being insulated on one side thus allowing an overall thermal gradient to be established. Obviously, the number of cells employed directly effects the magnitude of the thermal gradient during the transient temperature period but has little effect on the final equilibrium temperature conditions.

8. Control bath temperature during transient conditions in the example goes through two phases. First, the bath is cooled by both "hot" and "cold" active walls until it reaches the ambient air temperature. Thereafter, it loses heat to the cold chamber and gains heat from the hot chamber until the total heat transfer across each active wall is equal and the equilibrium temperature is achieved.

9. Assuming room air is an infinitely large heat source, the control bath temperature will remain constant until the cold chamber ice is expended.

Figure 2:
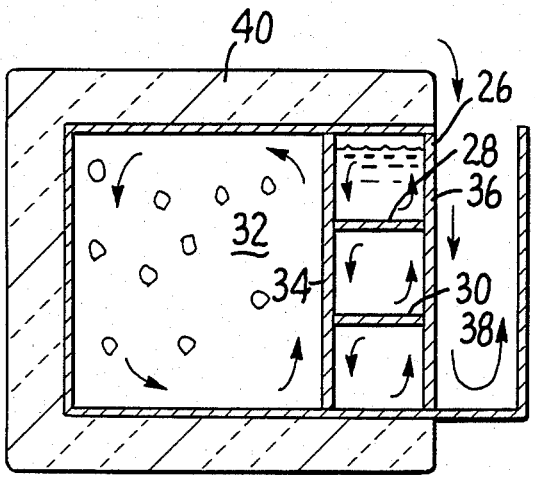
FIG. 2 is an embodiment of the invention wherein ambient air is used as the heat source.

FIG. 2 illustrates another embodiment of the invention wherein the sample chamber 26 is divided into three horizontal convective chambers by means of the baffles 28 and 30. The cold chamber 32 has a conductive wall 34 in heat exchange relationship with the sample chamber while the opposite wall 36 is also heat conductive but is merely in contact with ambient air in the chamber 38. Insulation 40 surrounds the cold chamber and the sample chamber as shown.

Figure 3:
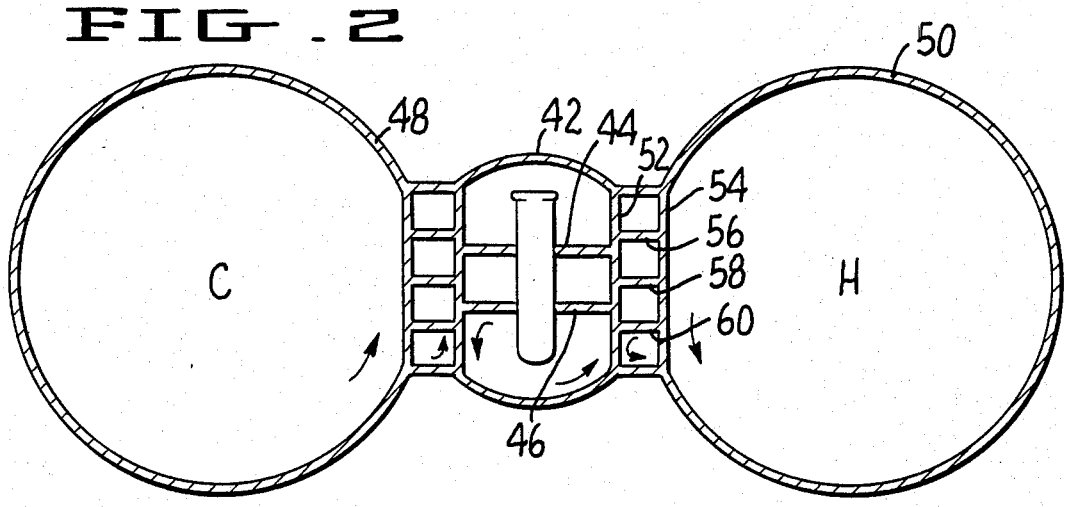
FIG. 3 is a sectional view of another embodiment of the invention having a plurality of convective cells at heat exchange elements between the sample chamber, the heat sink and the heat source.

FIG. 3 illustrates another embodiment of the invention where again the sample chamber 42 is divided into convective cells by means of the horizontal baffles 44 and 46. At each side of the sample chamber 42 are the usual cold chamber 48 and hot chamber 50 but these are not connected to the sample chamber by the simple conductive wall as in the previous examples but instead a more complex structure is employed. Thus, the sample chamber 42 has a conductive wall 52 while the hot chamber 50 has a conductive wall 54 with the walls 52 and 54 spaced from each other and separated into four convective cells by means of the horizontal baffles 56, 58 and 60. The space between the walls 52 and 54 can be any fluid which will convey heat from one wall to the other in a desired way so that the space may be filled with gas or a liquid. Obviously the size of the cells will be tailored to the particular amount of heat transfer desired. The sample chamber 42 is similarly connected to the cold chamber 48 by a plurality of cells but these are not described in detail since they are a mirror image of the cells heretofore described.

Figure 4:
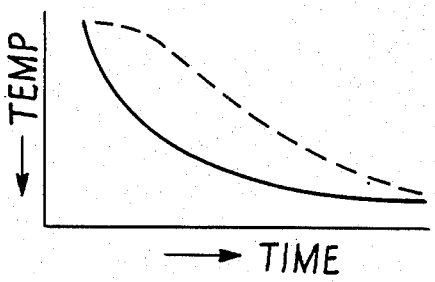
FIG. 4 is a graph showing the effect of dividing the sample chamber into a number of horizontal cells.

FIG. 4 consists of two curves showing one possible effect of adding hot fluid to intervening cells 54, 56, 58 and 60 at activation time. The solid curve illustrates the situation without intervening cells while the dash line shows the effect of adding the cells and loading them with a hot fluid at activation. The curves illustrate that the maximum rate of change of temperature can be made much more gradual when one employs the intervening cells. The converse is also true.

Figure 5:
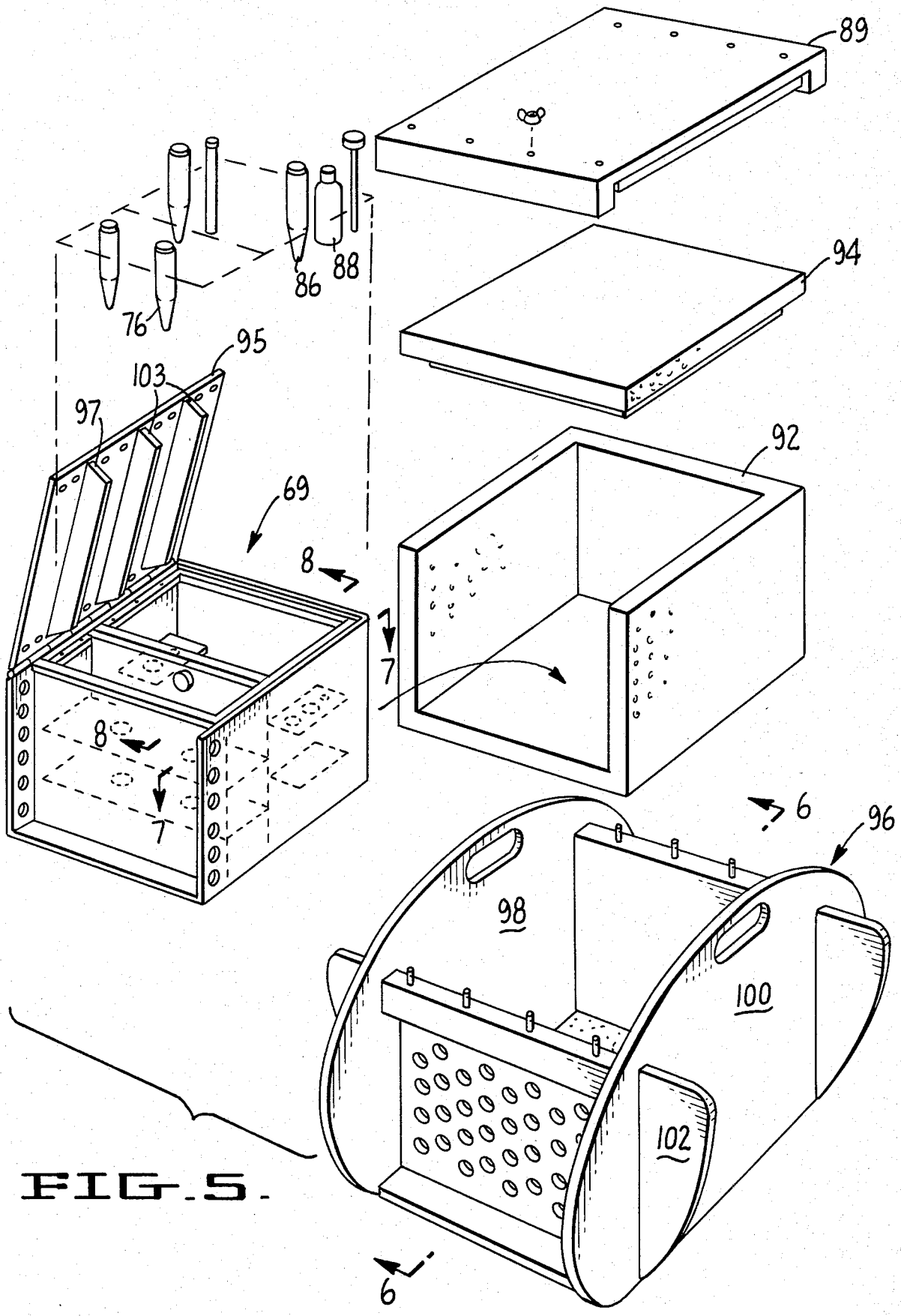
FIG. 5 is an exploded view of a preferred embodiment of the invention.
Figure 6:
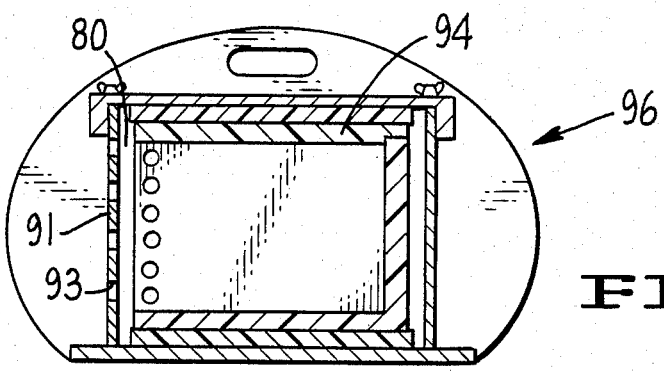
FIG. 6 is a section on the line 6—6 of FIG. 5.
Figure 7:
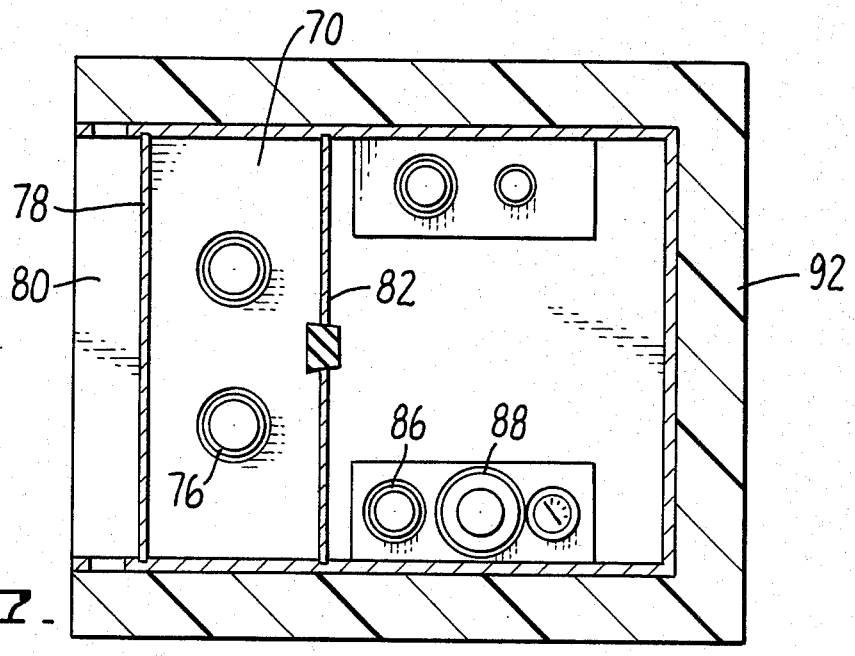
FIG. 7 is a section on the line 7—7 of FIG. 5.
Figure 8:
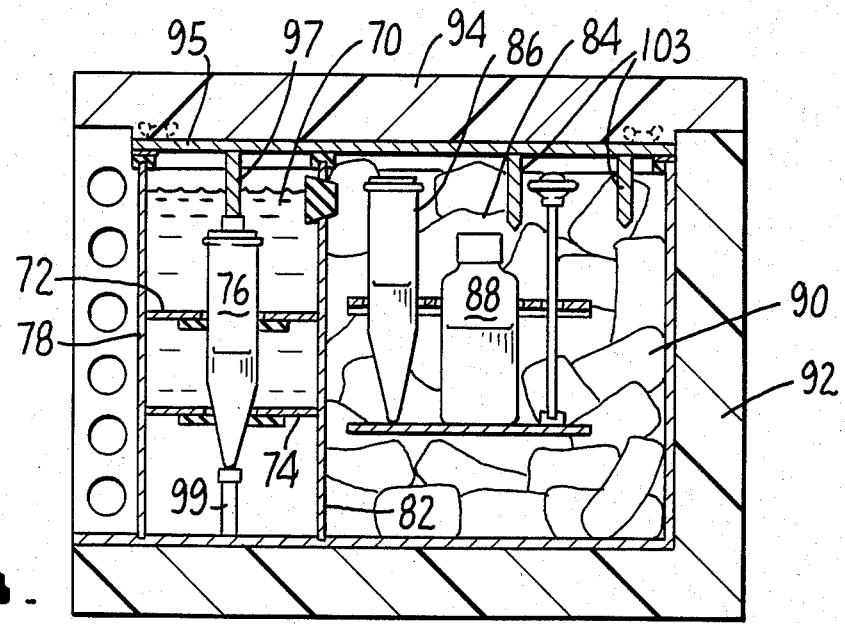
FIG. 8 is a section on the line 8—8 of FIG. 5.

FIGS. 5 through 8 illustrate a practical embodiment of the invention. FIG. 5 shows an exploded view of the device while FIGS. 6, 7 and 8 show various sections. In this embodiment of the invention, the main body of the shipping container is designated 69. The sample chamber 70 is divided into three sections by means of the conductive horizontal dividers 72 and 74. Preferably these baffles also serve as support members for the sample tube 76. The sample chamber 70 has a conductive wall 78 which is in heat exchange relationship with an ambient air space 80 while a similar conductive wall 82 is in heat exchange relationship with the cold chamber 84. Cold chamber 84 can be used as a storage place for various tubes and reagents such as at 86 and 88 and, in this embodiment of the invention, is largely filled with ice cubes 90. The chamber 69 fits within an insulated box-like member 92 having an insulated top 94 and a suitable protective cover 96. The actual top, which is attached to the chamber 69, is designated 95. Top 95 may also carry the support member 97 which is complementary to support 99 which extends up from the bottom. Stiffeners 103 may be added to cover 95 ensuring the cover 95 does not bend and therefore not seal the top of the chamber. The air space 80 has a wall 91 having a plurality of openings 93 so that air can freely circulate in this space. In this practical embodiment of the invention, a carrier box device, generally designated 96, is employed which has sides 98 and 100 which extend beyond the box at each end forming fins thereon while side fins such as at 102 are provided. These outstanding fins at the sides and ends are helpful when the shipping container is in use with mixed merchandise since it prevents the container from coming into direct contact with the walls of the vessel in which the device is shipped or other merchandise which might inhibit air circulation and thus interfere with the operation of the device.

The following example illustrates the design and performance of a practical embodiment of the invention.

Requirements for the passive transport container are:

1. Initial bath temperature=35° C.±5° C.
2. Initial bath temperature rate=20° C.±5° C./hr.
3. Bath temperature at $1\frac{1}{2}$ hrs.≦10° C.
4. Bath equilibrium temperature=4°±2° C. at 3 hrs.
5. Duration at 4°±2° C.=21 hrs.

FIG. 1 can be considered as a schematic of the thermal design. The bath containing the samples is insulated on the top, bottom and two sides and has metallic walls on two opposite sides. One of the metallic walls separates the bath from an ice/water compartment at 0° C., and the opposite metallic wall separates the bath from an air chamber which allows ambient air to circulate.

The energy balance on the bath, assuming no gradients in the bath, is given by Equation (1).

$$h_c A_c (T - T_c) + h_h A_h (T_A - T) + m_b C_{pb} \frac{dT}{d\theta} = 0 \qquad (1)$$

where $h_c$=overall convective heat transfer coefficient between ice chamber and bath $A_c$=area of conducting wall between ice chamber and bath $h_h$=overall convective heat transfer coefficient between bath and ambient air $A_h$=area of conducting wall between bath and ambient chamber $m_b$=mass of bath $C_p$=heat capacity of bath T=bath temperature $T_c$=ice chamber temperature $T_A$=ambient air temperature Solution to Equation 1 is given as Equation 2.

$$T = [T_A - T_f]e^{C_1\theta} + T_f \qquad (2)$$

$$\text{where } T_f = \text{final bath temperature} = \frac{h_c A_c T_c + h_h A_h T_A}{h_c A_c + h_h A_h}$$

$$C_1 = \frac{h_c A_c + h_h A_h}{m_b C_{pb}}$$

The initial bath temperature rate is obtained by differentiating (2) and setting $\theta=0$ which yields Equation (3):

$$\left.\frac{dT}{d\theta}\right|_{\theta=0} = -C_1[T_A - T_f] \qquad (3)$$

Assuming for the moment that $A_c=A_h=A$, $h_e$ and $h_A$ are known, quantities (by either analysis or measurement), and $C_{pb}$ is known, then specifying a given initial bath rate and a final bath temperature results in two equations for A and $m_b$ given as Equations (4) and (5):

$$-\left(\frac{A(h_c + h_h)}{m_b C_{pb}}\right)[T_A - T_f] = R \tag{4}$$

$$T_f = \frac{h_c T_c + h_h T_A}{h_c + h_h} \tag{5}$$

where R=initial specified bath temperature rate. If $A_c \neq A_h$, specifying a ratio between the two also leads to a proper set of equations for $m_b$, $A_c$ and $A_h$.

The final requirement for duration establishes the required initial mass of ice. Neglecting insulation leaks the heat addition rate to the ice chamber is given by Equation (6).

$$\overset{o}{Q}_i = h_c A_c (T - T_c) \tag{6}$$

The total heat added as a function of time is found by integrating (6).

$$Q_i = h_c A_c \int_0^{\theta} (T - T_c) d\theta \tag{7}$$

$$Q_i = h_c A_c \left[\frac{(T_A - T_f)}{C_1}(1 - e^{-C_1\theta})\right] + (T_f - T_c)\theta \tag{8}$$

for sufficiently large $\theta$ $$Q_i + h_c A_c \left[\frac{T_A - T_f}{C_1} + (T_f - T_c)\theta\right]. \tag{9}$$

This energy is supplied by melting a quantity of ice, $m_i$ for which 80 calories are required to melt 1 gram. Thus, $$m_i\left(80 \frac{\text{cal}}{\text{gm}}\right) = Q_i \tag{10}$$

Given a duration requirement, $\theta$, Equations (9) and (10) can be solved for $m_i$.

Thus, all independent parameters, A, $m_b$ and $m_i$ have been selected to meet the design requirements.

It was found in practice that gradients did develop in the bath due to density variations with temperature, and horizontal baffles were required to limit the maximum vertical temperature gradient.

Many variations can be made without departing from the spirit of this invention. Thus, the basic invention can be employed in a number of ways. Examples of preferred embodiments are described below.

1. Active wall characteristics. The area, shape, material, surface finish and thickness determine their thermal heat transfer capacity.
2. Mass. The mass of material in each chamber affects the sample baths transient and equilibrium temperatures and the temperature maintenance time.
3. Media. Fluids and solids selected for each chamber determine initial transient and equilibrium temperatures. Examples are:

| | Cold Chamber | Control Bath | Hot Chamber |
|---|---|---|---|
| (a) | Solid $CO_2$ & $CO_2$ | Brine | Water Ice & Water |
| (b) | Water Ice & Water | Water | Air |
| (c) | Water Ice & Brine | Brine | Air |
| (d) | Gel Pacs & Water | Water | Air |
| (e) | Solid $CO_2$ & $Co_2$ Gas | Ethylene Glycol | Water Ice & Brine |

4. Convective Cells. The number and relative size of the convective cells in each chamber can be tailored to obviate any adverse temperature gradient.
5. Additional Cells. The basic invention can be expanded by placing transient controlling chamber on either or both sides of the control bath (see FIG. 3) employing hot or cold fluids at activation, thus achieving a compound thermal transient (see FIG. 4). Convective cells may or may not be used depending upon the effect desired. Thermal equilibrium is likewise compounded but predictable.

Biogenetic Shipping Container

The invention has been reduced to practice in a shipping container for the cool down and aerial shipment of sensitive live biological material. The design shown in FIGS. 5–8 has been constructed, exhaustively tested in the laboratory and tested under actual field conditions. In a practical embodiment, the cold chamber employed 4400 grams of water ice and 1300 ml of water and did not require division into convective cells. The control bath contained 4000 ml of water at an initial temperature of 35° C. maximum. It contains two centrifuge tubes containing the biological material. These are held in place by a bottom support and by two horizontal baffles which divide the bath into three convective cells. The hot chamber is effected by exposing the "hot" active wall to ambient air. All other sides of the container are insulated by two inches of styrofoam. Brackets mounted within the cold chamber allow for mounting a dial thermometer for shipment of media and for preparation of the biological material under controlled temperature conditions prior to initiating the temperature conditioning cycle. The cool down actually occurs during shipment.

We claim:

1. A passive temperature control device comprising in combination:
   a. a container,
   b. a first chamber for holding a sample in said container,
   c. said first chamber having at least two spaced heat conductive vertically opposed baffles forming at least a part of the walls of said first chamber,
   d. a plurality of heat conductive horizontal baffles within said first chamber connecting said vertical baffles and forming a plurality of horizontal sealed compartments within said first chamber,
   e. a second chamber in heat exchange relationship with one of said vertical baffles,
   f. a third chamber in heat exchange relationship with another of said vertical baffles,
   g. convective fluids in said second and third chambers of said container,
   h. a carrier box for holding said container, an end wall of said carrier box having a plurality of openings for permitting flow of convective fluid therethrough, i. said second chamber serving as a heat sink and said third chamber serving as a heat source, and j. means for preventing the inhibiting of fluid circulation through the openings of the carrier box end wall and the third chamber of said container comprising a first set of outwardly extending fins and a second set of outwardly extending fins at right angles thereto which space said carrier box from surrounding objects during shipment and the like.

2. The structure of claim 1 wherein the second chamber is filled with a mixture of ice and water and the third chamber is open to ambient air.

* * * * *